US007498992B2

(12) United States Patent
Hung et al.

(10) Patent No.: US 7,498,992 B2
(45) Date of Patent: Mar. 3, 2009

(54) MULTI-FREQUENCY ANTENNA SUITABLY WORKING IN DIFFERENT WIRELESS NETWORKS

(75) Inventors: Chen-Ta Hung, Tu-Cheng (TW); Hsien-Sheng Tseng, Tu-Cheng (TW); Lung-Sheng Tai, Tu-Cheng (TW); Shu-Yean Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/906,691

(22) Filed: Oct. 2, 2007

(65) Prior Publication Data

US 2008/0030407 A1 Feb. 7, 2008

Related U.S. Application Data

(63) Continuation of application No. 11/201,463, filed on Aug. 11, 2005, now Pat. No. 7,289,071.

(51) Int. Cl.
*H01Q 1/24* (2006.01)

(52) U.S. Cl. ..... 343/702; 343/700 MS

(58) Field of Classification Search ..... 343/702, 343/700 MS, 846, 725
See application file for complete search history.

(56) References Cited

U.S. PATENT DOCUMENTS

| | | | | |
|---|---|---|---|---|
| 7,026,999 | B2 * | 4/2006 | Umehara et al. | 343/702 |
| 7,050,010 | B2 * | 5/2006 | Wang et al. | 343/702 |
| 7,339,531 | B2 * | 3/2008 | Desclos et al. | 343/702 |
| 2004/0046697 | A1 * | 3/2004 | Tai et al. | 343/700 MS |

* cited by examiner

*Primary Examiner*—Hoang V Nguyen
(74) *Attorney, Agent, or Firm*—Wei Te Chung

(57) ABSTRACT

A multi-frequency antenna includes a first antenna (1) and a second antenna (2) both operating at wireless wide area network, a third antenna (3) and a fourth antenna (4) both operating at wireless local area network. The first antenna, the second antenna, the third antenna and the fourth antenna are integrally made from a metal sheet and have a common grounding portion (50). The first and the second antennas have a first connecting portion (12) on which a feeding point (120) is located, and the third and the fourth antenna have a second connecting portion (34) on which another feeding point (340) is located.

19 Claims, 5 Drawing Sheets

MULTI-FREQUENCY ANTENNA SUITABLY WORKING IN DIFFERENT WIRELESS NETWORKS

CROSS-REFERENCE TO RELATED APPLICATION

This application is a CA (Continuation of Application) of U.S. patent application Ser. No. 11/201,463, filed Aug. 11, 2005, now U.S. Pat. No. 7,289,071, and entitled "MULTI-FREQUENCY ANTENNA SUITABLY WORKING IN DIFFERENT WIRELESS NETWORKS", which has the same applicant and assignee as the present invention.

BACKGROUND OF THE INVENTION

1. Field of the Invention

The present invention relates generally to an antenna, and more particularly to a multi-frequency antenna for a wireless communication device.

2. Description of Prior Art

With the high-speed development of the mobile communication, people more and more expect to use a computer or other portable terminals to optionally connect to Internet. GPRS (General Packer Radio Service) and WLAN (Wireless Local Area Network) allow users to access data wirelessly over both cellular networks and 802.11b WLAN system. When operating in GPRS, the data transmitting speed is up to 30 Kbps~50 Kbps, while when connected to a WLAN access point, the data transmitting speed is up to 11 Mbps. People can select different PC cards and cooperate with the portable terminals such as the notebook computer and etc. to optionally connect to Internet. Since WLAN has a higher transmitting speed, WLAN is usually used to provide public WLAN high-speed data service in some hot areas (for example, hotel, airport, coffee bar, commerce heartland, conference heartland and etc.). When leaving from these hot areas, network connection is automatically switched to GPRS.

As it is known to all, an antenna plays an important role in wireless communication. As a result, the PC card may choose individual antennas to respectively operate at WWAN (Wireless Wide Area Network), namely GPRS, and WLAN. However, the two individual antennas will inevitably occupy more space than a single antenna in general. Hence, it is necessary to be concerned by researchers skilled in the art how to incorporate two antennas respectively operating at WWAN and WLAN into a single antenna.

SUMMARY OF THE INVENTION

An object of the present invention is to provide a multi-frequency antenna which can integrate the antenna for WWAN and the antenna for WLAN together, thereby reducing the installation space of the antenna and the antenna having the excellent performance.

To achieve the aforementioned object, the present invention provides a multi-frequency antenna comprising a grounding element, a first type of antenna, and a second type of antenna. The first type of antenna works in a first wireless network including a first radiating body and a first connecting portion connecting the grounding element and the first radiating body. The second type of antenna works in a second wireless network including a second radiating body and a second connecting portion connecting the grounding element and the second radiating body. The first connecting portion is longer than the second connecting portion, and the first radiating body is longer than the second radiating body.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
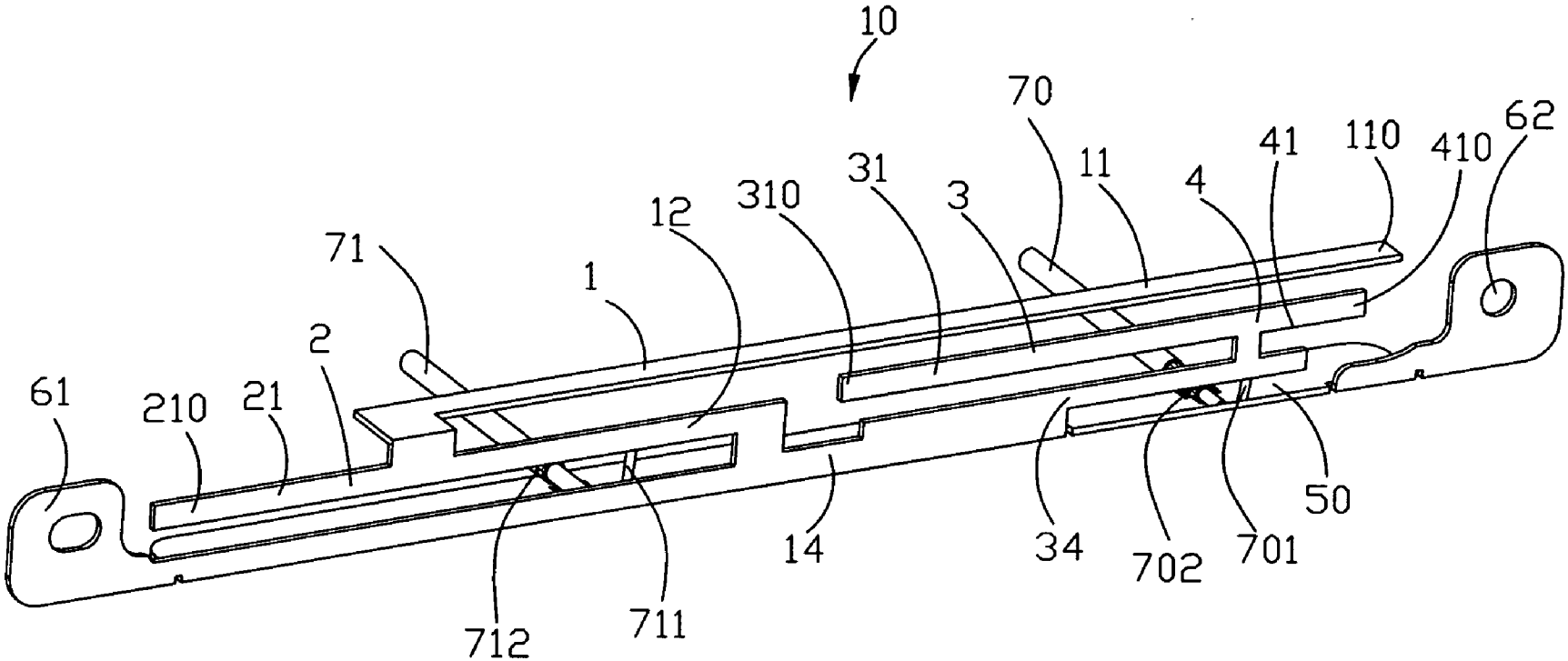
FIG. 1 is a perspective view of a multi-frequency antenna in accordance with a preferred embodiment of the present invention.
Figure 2:
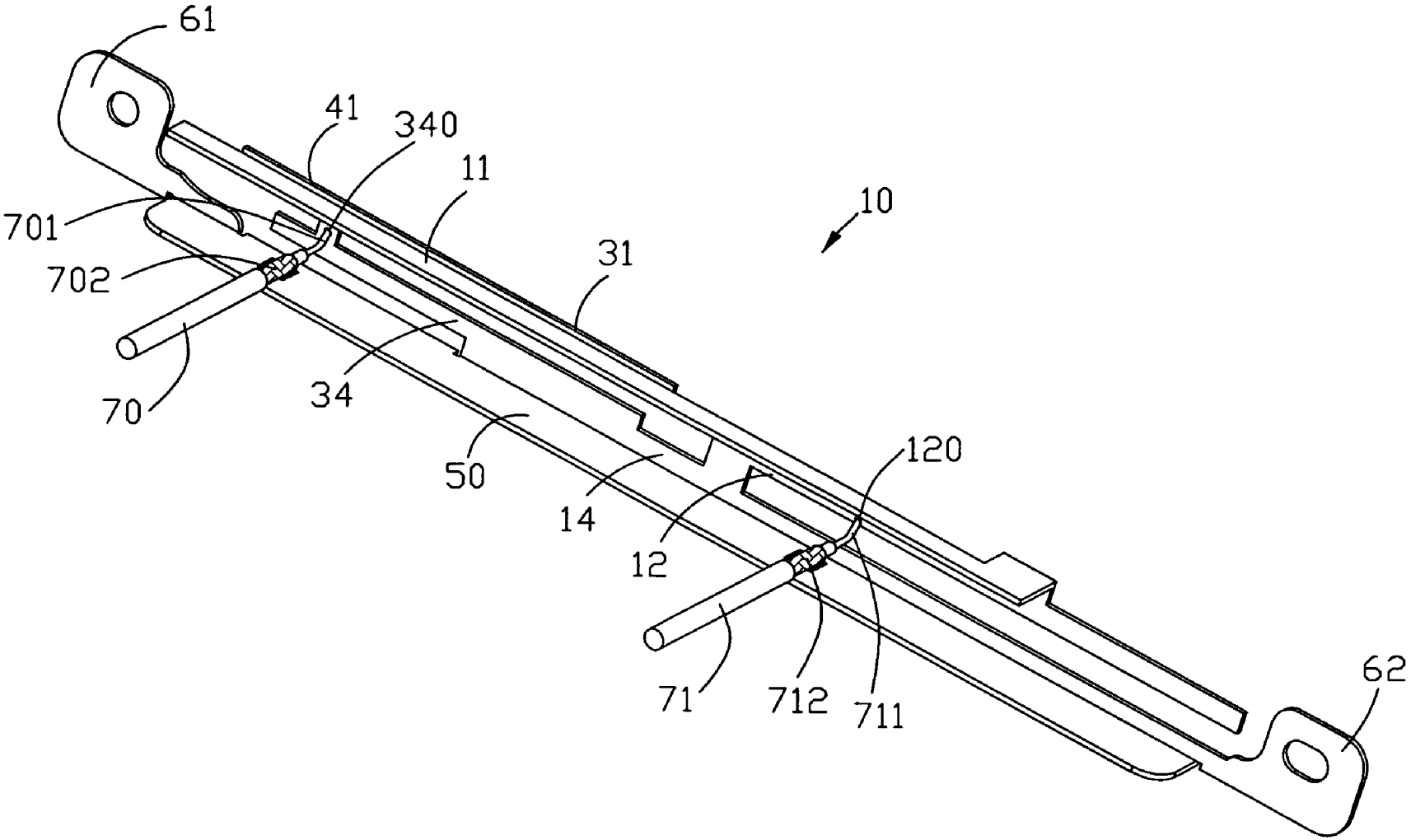
FIG. 2 is a view similar to FIG. 1, but from a different aspect.

Referring to FIGS. 1 and 2, a multi-frequency antenna 10 in accordance with a preferred embodiment of the present invention comprises a first type of antenna which is used in WWAN and has first and second antennas 1, 2, and a second type of antenna which is used in WLAN and has third and fourth antenna 3, 4. The multi-frequency antenna 10 is integrally made from a metal sheet and can integrate the first type of antenna for WWAN and the second type of antenna for WLAN together.

The multi-frequency antenna 10 has a first installing portion 61 and a second installing portion 62 at opposite ends thereof, which form an installing plane. The multi-frequency antenna 10 comprises a common grounding portion 50 for the first, the second, the third and the fourth antennas 1, 2, 3, 4. A lengthwise portion 14 extends perpendicularly and upwardly from the grounding portion 50, which is connected to the first installing portion 61 at one end thereof. The first antenna 1 and the second antenna 2 include a first connecting portion 12 extending upwardly from the lengthwise portion 14. The first antenna 1 comprises a first radiating element 11, which is coupled to the grounding portion 50 by the first connecting portion 12 and the lengthwise portion 14. The first radiating element 11 is designed in a tri-dimensional manner and extends in a lengthwise direction, thereby reducing the width of the installing plane in a traverse direction. A plane in which the first connecting portion 12 and the lengthwise portion 14 are located is defined as a first plane, a plane in which the first radiating element 11 is located is defined as a second plane, and a plane in which the grounding portion 50 is located is defined as a third plane. The first plane is respectively orthogonal to the second plane and the third plane, and the first plane and the installing plane are coplanar. The radiating element 11 of the first antenna 1 extends towards the second installing portion 62 in the first plane with a free end 110 thereof adjacent to the second installing portion 62. The central frequency the first antenna 1 operates at is about 900 MHz. The second antenna 2 comprises a second radiating element 21, which extends from the first connecting portion 12 towards the first installing portion 61 with a free end 210 thereof close to the installing portion 61. The second radiating element 21 is shorter than the first radiating portion 11. The central frequency the second antenna 2 operates at is about 1900 MHz. A feeding point 120 for the first antenna 1 and the second antenna 2 is located on the first connecting portion 12. The first and the second antennas 1, 2 are provided power by a first coaxial cable 70 with an inner conductor 701 of the coaxial cable 70 welded to the feeding point 120 and an outer conductor 702 welded to the grounding portion 50. Both of the first antenna 1 and the second antenna 2 are inverted-F antennas.

The third antenna 3 comprises a third radiating element 31, and the fourth antenna 4 comprises a fourth radiating element 41. The fourth radiating element 41 is shorter than the third radiating element 31. Total length of the third radiating element 31 and the fourth radiating element 41 is shorter than the first radiating element 11 and the second radiating element 21. The third and the fourth antennas have a second connecting portion 34 connected to an end of the lengthwise portion 14. The second connecting portion 34 is shorter than the first connecting portion 12. The third and fourth radiating element 31, 41 is connected to the grounding portion 50 by the second connecting portion 34 and the lengthwise portion 14, thereby forming two inverted-F antennas. The third and the fourth radiating element 31, 41 are arranged in a line and extend from an end of the second connecting portion 34 in opposite directions. The third radiating element 31 extends towards the first installing portion 61 and the fourth radiating element 41 extends towards the second installing portion 62. A feeding point 340 for the third antenna 3 and the fourth antenna 4 is located on the second connecting portion 34. Likewise, the third and the fourth antennas 3, 4 are provided power by a second coaxial cable 71 with an inner conductor 711 of the coaxial cable 71 welded to the feeding point 340 and an outer conductor 712 welded to the grounding portion 50. The third antenna operates at the central frequency of 2.4 GHz and the fourth antenna operates at the central frequency of 5.2 GHz.

The first radiating element 11 of the first antenna 1 operating at WWAN and the third radiating element 31 of the third antenna 3 operating at WLAN are interlaced with each other so as to make the distance between the two free ends 110, 310 as far as possible for reducing the interference between the two antennas 1, 3. The interval between the central frequencies of the second antenna 2 and the third antenna 3 is smallest so that the interference between the two antennas can be produced easily. In the preferred embodiment, the space between the second antenna 2 and the third antenna 3 may make both of the antennas work perfectly. The second radiating element 21 of the second antenna 2, the third radiating element 31 of the third antenna, the fourth radiating element 41 of the fourth antenna 4, the first and second connecting portions 12, 34 and the lengthwise portion 14 are positioned on an identical planar, namely the first planar. The multi-frequency antennas of the preferred embodiment can be attached to two opposite sides in an upper end of the display of a computer, and can be fed power by feeding lines so as to make the multi-frequency antenna be employed at different wireless network cards.

Figure 3:
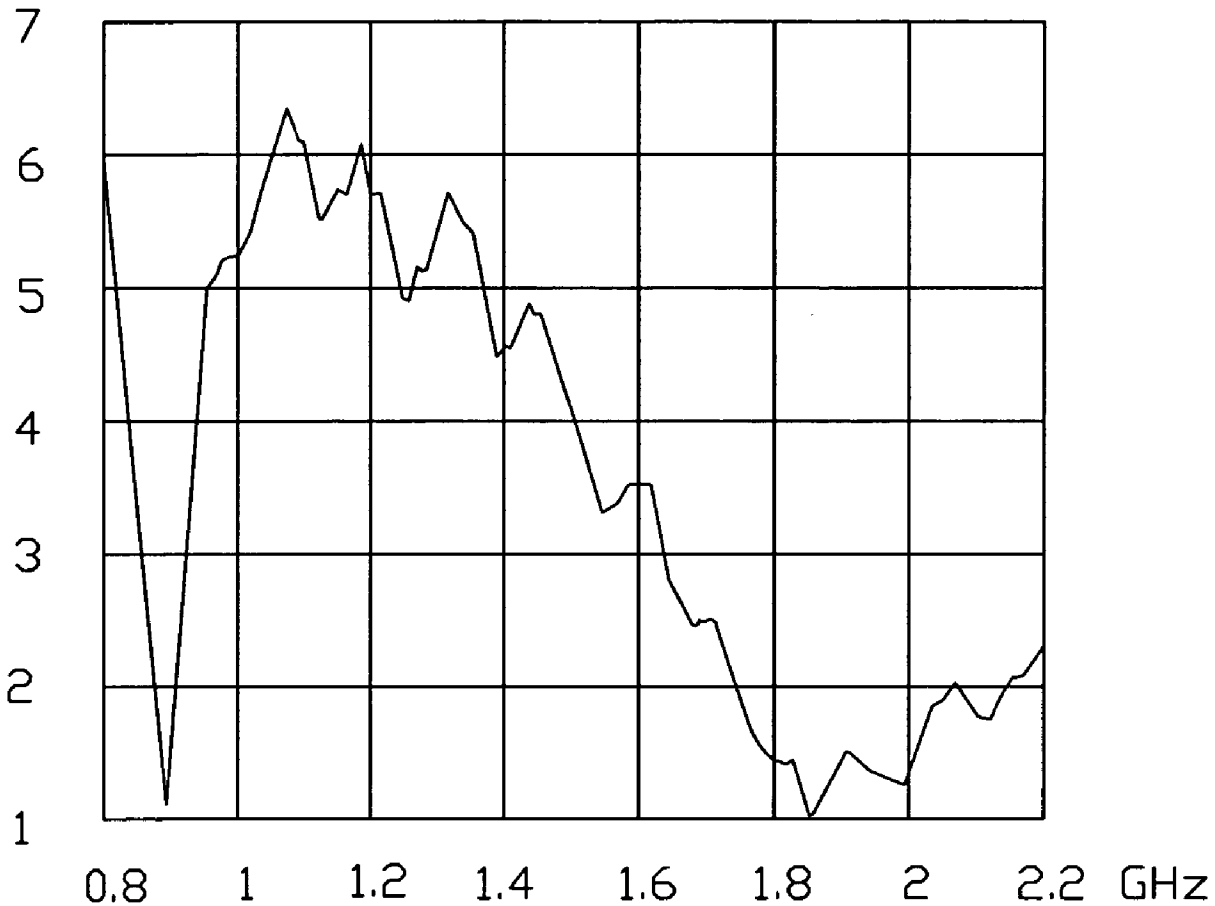
FIG. 3 is a test chart recording for the multi-frequency antenna of FIG. 1, showing Voltage Standing Wave Ratio (VSWR) as a function of WWAN frequency.
Figure 4:
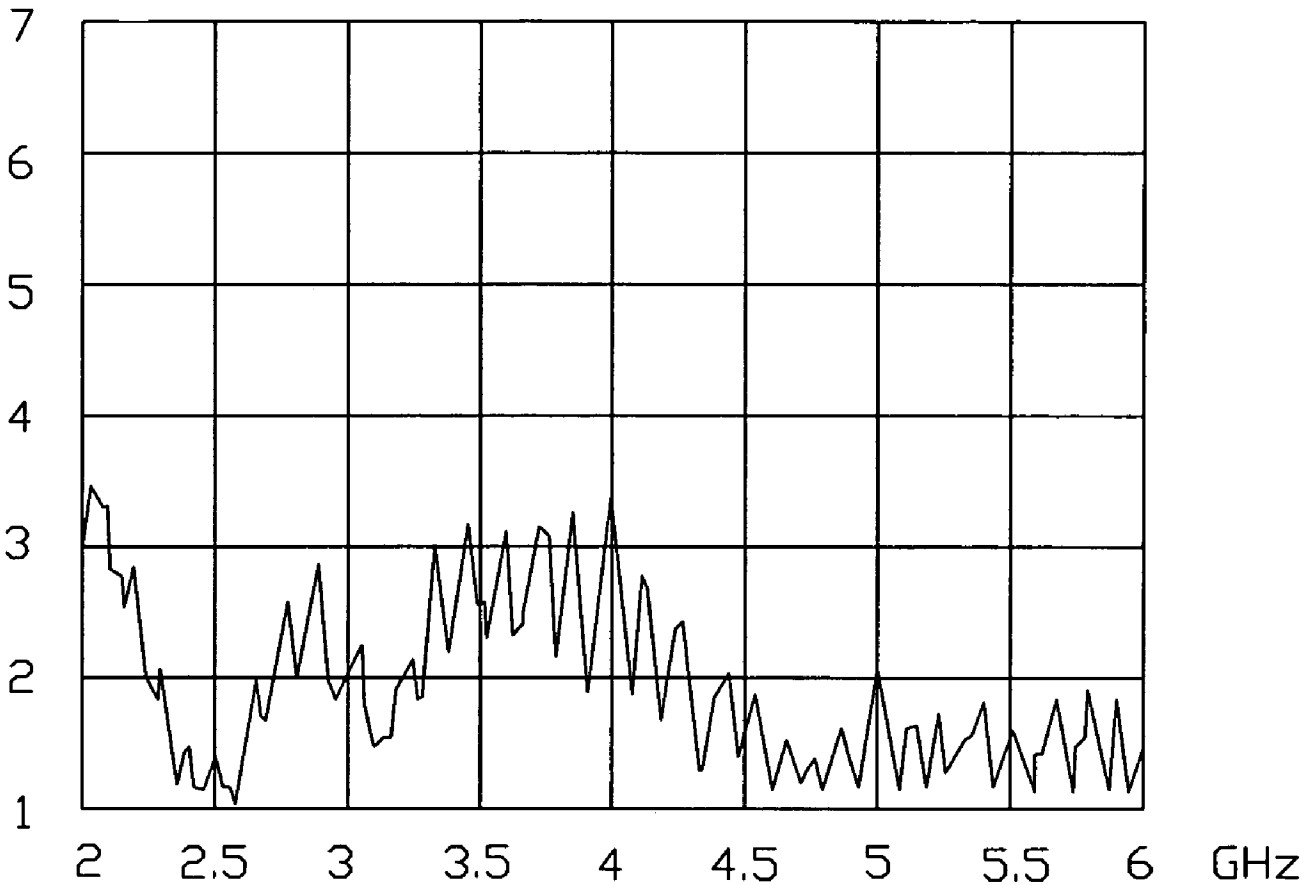
FIG. 4 is a test chart recording for the multi-frequency antenna of FIG. 1, showing Voltage Standing Wave Ratio (VSWR) as a function of WLAN frequency.
Figure 5:
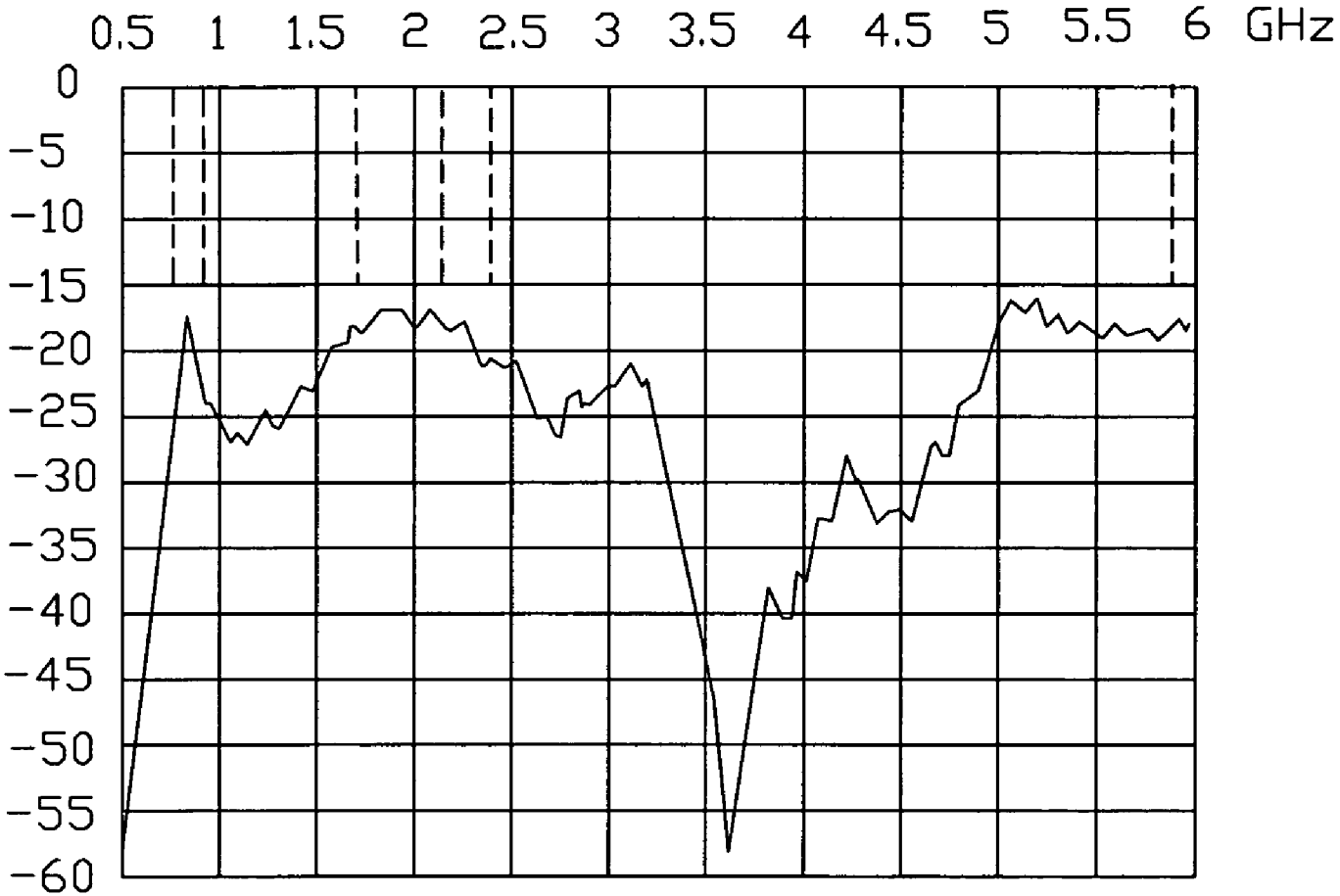
FIG. 5 is a test chart recording for the multi-frequency antenna of FIG. 1, showing isolation as a function of frequency.

FIG. 3 is a test chart of Voltage Standing Wave Ratio (VSWR) of the combined WWAN antennas, wherein x-coordinate defines frequency and y-coordinate defines VSWR. Likewise, FIG. 4 is a test chart of Voltage Standing Wave Ratio (VSWR) of the combined WLAN antennas, wherein x-coordinate defines frequency and y-coordinate defines VSWR. A perfect value of VSWR is 1 dB that is considered having best receiving quality. Generally speaking, VSWR under 2 dB is considered having good receiving quality. Under the definition of the VSWR less than 2 dB, it can be clearly seen from FIG. 3 that the values of the VSWR around 900 MHz and 1900 MHz can satisfy the definition as well as the values of the VSWR around 2.4 GHz and 5.2 GHz in FIG. 4 can satisfy the definition so that the efficiency for receiving the frequencies is excellent. FIG. 5 is a test chart of isolation of the multi-frequency antenna with x-coordinate defining frequency and y-coordinate defining isolation. It can be seen that the values of the isolation during the frequencies of WWAN and WLAN are less than −15 dB and can satisfy the requirement in practice.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-frequency antenna comprising:

a grounding element;

a first type of antenna, working in a first wireless network, including a first radiating body and a first connecting portion connecting the grounding element and the first radiating body; and a second type of antenna, working in a second wireless network, including a second radiating body and a second connecting portion connecting the grounding element and the second radiating body;

wherein the first connecting portion is longer than the second connecting portion, and the first radiating body is longer than the second radiating body, further comprising a first coaxial cable and a second coaxial cable, wherein the first coaxial cable is coupled to the first type of antenna, the second coaxial cable is coupled to the second type of antenna.

2. The multi-frequency antenna as claimed 1, wherein the first radiating body comprises a first radiating element extending in a first direction and a second radiating element extending in a second direction opposite to the first direction.

3. The multi-frequency antenna as claimed in claim 2, wherein the first radiating element is longer than the second radiating element, the first radiating element transmits a first wireless signal of the first wireless network, and the second radiating element transmits a second wireless signal of the first wireless network.

4. The multi-frequency antenna as claimed in claim 3, wherein the frequency of the first wireless signal is 900 MHz, and the frequency of the second wireless signal is 1800 MHz.

5. The multi-frequency antenna as claimed 1, wherein the second radiating body comprises a third radiating element extending in a second direction and a fourth radiating element extending in a first direction opposite to the second direction.

6. The multi-frequency antenna as claimed in claim 5, wherein the third radiating element is longer than the fourth radiating element, the third radiating element transmits a third wireless signal of the second wireless network, and the fourth radiating element transmits a fourth wireless signal of the second wireless network.

7. The multi-frequency antenna as claimed in claim 6, wherein the frequency of the third wireless signal is 2.4 GHz, and the frequency of the fourth wireless signal is 5.2 GHz.

8. The multi-frequency antenna as claimed in claim 1, wherein the grounding element, the first radiating body and the first connecting portion commonly defines a space in which the second type of antenna is received.

9. The multi-frequency antenna as claimed in claim 8, wherein in a plane view, the space is open to an exterior in only a direction along which the first radiating body extends.

10. A multi-frequency antenna for WWAN and WLAN, comprising:

a ground element;

a WWAN antenna, connected to the ground element and comprising a first radiating element and a second radiating element, wherein the first and second radiating elements operating in a first frequency band and a second frequency band respectively; and a WLAN antenna, connected to the ground element and comprising a third radiating element and a fourth radiating element, wherein the third and fourth radiating elements operating in a third frequency band and a fourth frequency band respectively.

11. The multi-frequency antenna as claimed in claim 10, wherein the first frequency band is 900 Mhz, the second frequency band is 1900 MHz, the third frequency band is 2.4 GHz, and the fourth frequency band is 5.2 GHz.

12. The multi-frequency antenna as claimed in claim 10, wherein the WWAN antenna further comprises a first connecting element for connecting the first radiating element and the second radiating element to the ground element, the first radiating element and the second radiating element extend in two opposite directions; the WLAN antenna further comprises a second connecting clement for connecting the third radiating element and the fourth radiating element to the ground element, and the third radiating element and the fourth radiating element extend in two opposite directions.

13. The multi-frequency antenna as claimed in claim 12, wherein the first connecting element and the second connecting element are disposed on a first plane, the first radiating element is disposed on a second plane, the ground element is disposed on a third plane.

14. The multi-frequency antenna as claimed in claim 13, wherein the first plane is respectively orthogonal to the second plane and the third plane.

15. The multi-frequency antenna as claimed in claim 13, wherein the multi-frequency antenna has an installing portion in an installing plane.

16. The multi-frequency antenna as claimed in claim 15, wherein the installing plane and the first plane are coplanar.

17. A multi-frequency antenna for two wireless networks, comprising:

a ground element;

a first type antenna, operating in a first wireless network and comprising a first feeding point;

a second type antenna, operating in a second wireless network and comprising a second feeding point;

a first coaxial cable, comprising an inner conductor electrically connecting to the first feeding point and an outer conductor electrically connecting to the ground element; and a second coaxial cable, comprising an inner conductor electrically connecting to the second feeding point and an outer conductor electrically connecting to the ground element.

18. The multi-frequency antenna as claimed in claim 17, wherein said first type of antenna comprises a first radiating element, a second radiating element, and a first connecting element connecting the ground metal plane and the first and second radiating elements.

19. The multi-frequency antenna as claimed in claim 18, wherein said second type of antenna comprises a third radiating element, a fourth radiating element, and a second connecting element connecting the ground metal plane and the third and fourth radiating elements.

* * * * *